US006425496B1

(12) United States Patent
Schülein

(10) Patent No.: US 6,425,496 B1
(45) Date of Patent: Jul. 30, 2002

(54) INDICATOR TAB FOR CARAFE

(75) Inventor: Rolf Schülein, Nassau/Lahn (DE)

(73) Assignee: The Pampered Chef, Ltd., Addison, IL (US)

( * ) Notice: Subject to any disclaimer, the term of this patent is extended or adjusted under 35 U.S.C. 154(b) by 0 days.

(21) Appl. No.: 09/652,269

(22) Filed: Aug. 31, 2000

(51) Int. Cl.[7] ..... B67D 5/06
(52) U.S. Cl. ..... 222/23; 222/47; 116/200; 116/201
(58) Field of Search ..... 222/23, 47; 116/200, 116/201

(56) References Cited

U.S. PATENT DOCUMENTS 4,519,428 A * 5/1985 Moody ..... 141/98
5,707,234 A * 1/1998 Bender ..... 433/90

* cited by examiner

*Primary Examiner*—J. Casimer Jacyna
(74) *Attorney, Agent, or Firm*—Olson & Hierl, Ltd.

(57) ABSTRACT

A reversible indicator tab is provided for a carafe of the type having a lever with a free end extending therefrom. The indicator tab includes a hollow cap having a top wall, a bottom wall, and a pair of side walls. The top and bottom walls are spaced apart and are connected to the side walls. The side walls are spaced apart and are connected to the top and bottom walls. The walls define at least one open end sized to receive the free end of the lever. The lever is receivable in at least two different orientations relative to the top wall. The top wall is readily visually distinguishable from the bottom wall by color.

19 Claims, 3 Drawing Sheets

INDICATOR TAB FOR CARAFE

TECHNICAL FIELD OF THE INVENTION

This invention relates to containers or carafes for holding and dispensing hot or cold beverages, and more particularly to an indicator tab for indicating the nature of the contents of the carafe.

BACKGROUND OF THE INVENTION

In restaurants, at buffets, and in meeting rooms, for example, it is common to provide refreshments for patrons, guests or participants. Such beverages can include coffee, regular and decaffeinated, hot water for tea, cold water and other popular drinks. To keep hot beverages hot, and cold beverages cold, vacuum bottle type carafes can be used. Often multiple carafes of the same style are used. Because such carafes are naturally opaque and it is desirable to keep the lids on to alleviate heat transfer to and from the atmosphere, the contents cannot readily be discerned prior to pouring the contents therefrom. To save time and avoid confusion as well as customer dissatisfaction, it is desirable to be able to discern prior to pouring whether a particular carafe contains regular or decaffeinated coffee, or hot or cold water, for example.

It is known to place a label or placard in front of the carafe designating its contents, but this does not avoid the problem of the carafe being removed from one location and returned to another, such that the labels or placards are no longer accurate. It is also known to provide carafes or handled pots having permanent indicia thereon, either in the form of words or color codes, to indicate the nature of the contents. For example, decaffeinated coffee containers may have an orange or other distinctively colored handle or lid. Such permanently marked containers or carafes lack flexibility, in that carafes so marked cannot be used for regular coffee or other beverages without causing confusion. The number of carafes dedicated to decaffeinated coffee may vary depending on the preferences of the people being served at a particular event.

It would be desirable to provide an indicator tab that can be connected to or removed from a carafe, in response to demand, so that a particular carafe can be used for different contents at different times. It would also be desirable to provide such an indicator tab that is capable of indicating more than one type of contents.

These and other desirable features are provided by the present invention.

SUMMARY OF THE INVENTION

The present invention, according to one aspect thereof, provides an indicator tab for a carafe of the type having a lever with a free end extending therefrom. The indicator tab includes a hollow cap having a top wall, a bottom wall, and a pair of side walls. The top and bottom walls are spaced apart and connected to the side walls. The side walls are spaced apart and connected to the top and bottom walls. The top wall, bottom wall and pair of side walls define at least one open end sized to receive the free end of the lever.

According to another aspect of the present invention, a reversible indicator tab is provided for a carafe of the type having a lever with a free end extending therefrom. The indicator tab includes a hollow cap having a top wall, a bottom wall, and a pair of side walls. The top and bottom walls are spaced apart and are connected to the side walls. The side walls are spaced apart and are connected to the top and bottom walls. The top wall, bottom wall and pair of side walls define at least one open end sized to receive the free end of the lever. The lever is receivable in at least two different orientations relative to the top wall. The top wall is readily visually distinguishable from the bottom wall.

In accordance with yet another aspect of the present invention, a method of indicating the contents of a carafe of the type having a lever with a free end extending therefrom involves providing an indicator tab removably attachable to the lever in at least two different orientations. Each of the at least two orientations of the indicator tab is readily visually distinguishable from the other. The indicator tab is attached to the lever in a selected one of the at least two orientations representative of the contents of the carafe.

These and other aspects of the invention are described below in the description of the preferred embodiment made with reference to the drawings.

DESCRIPTION OF THE PREFERRED EMBODIMENT

Figure 1:
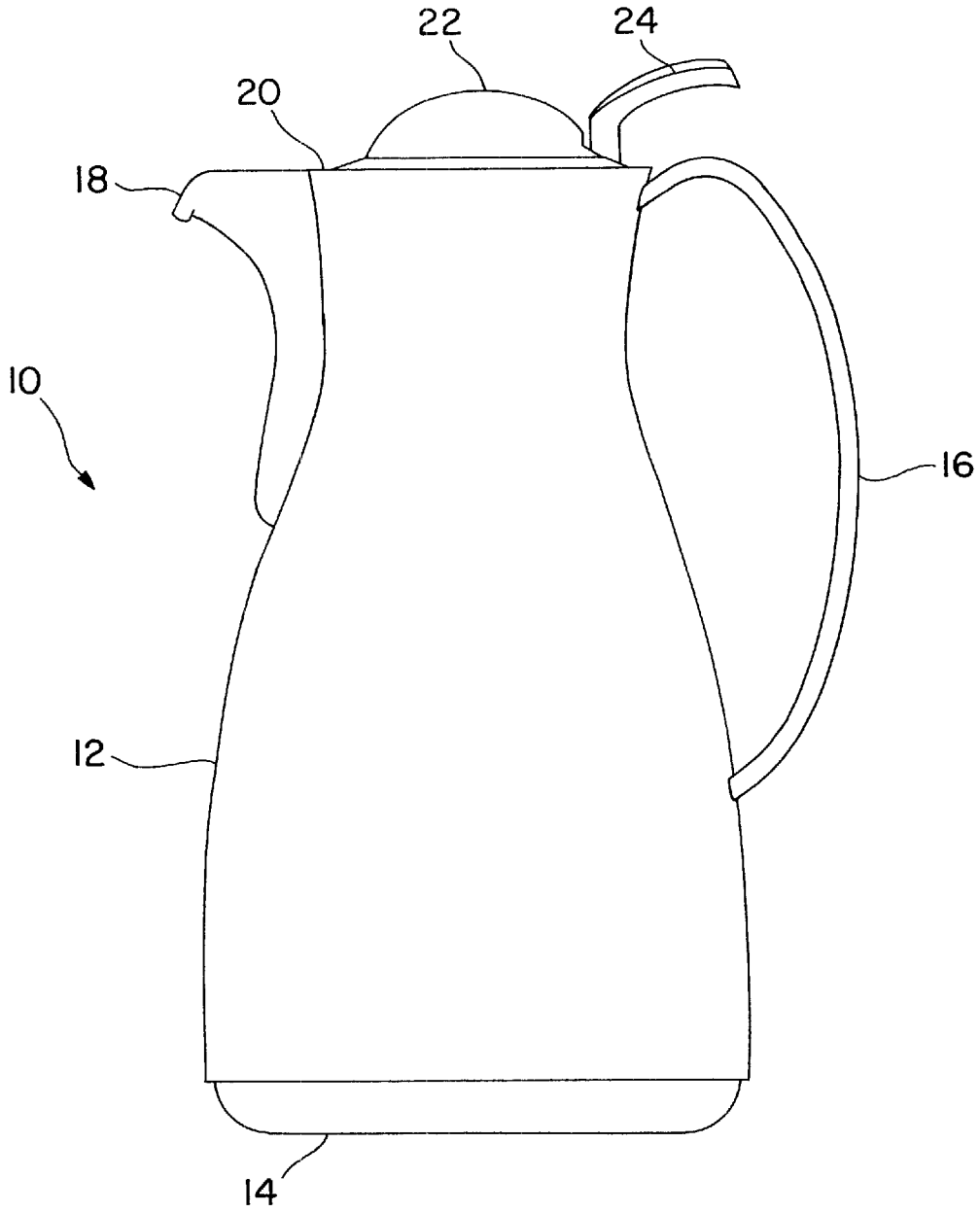
FIG. 1 is an elevational view of a carafe that is useful in combination with the present invention.

Referring to FIG. 1, there is illustrated a carafe 10 of a type with which the present invention can be usefully employed. Carafe 10 includes a body 12 having a threadedly attached, removable bottom 14, a handle 16 suitable for grasping the carafe for lifting and pouring, and a spout 18 from which liquid contents can be poured. Not shown, but disposed within carafe body 12 is a double-walled, vacuum insulated, mirrored glass bottle having an opening at the top end thereof communicating with the top 20 of carafe 10. By rotating and unthreading bottom 14 from body 12, the vacuum insulated bottle can be removed from body 12 for replacement in the event of breakage.

Closing top 20 of carafe 10 is a lid 22 threadedly received within body 12. Lid 22 includes a movable seal (not shown) that alternately opens or closes relative to the top of the vacuum insulated bottle to permit or prevent communication between the interior of the vacuum insulated bottle and spout 18. The movable seal is connected to and operated by movement of lid-lever 24, which can be depressed by the user's thumb to move pivotally relative to lid 22. When lid-lever 24 is depressed toward carafe body 12, the contents can be poured therefrom. When lid-lever 24 is in its normal raised position, as shown in FIG. 1, carafe 10 is sealed and the contents cannot be poured therefrom even if carafe 10 is tipped.

In the configuration shown in FIG. 1, the contents of carafe 10 can be indicated by the absence of the indicator tab of the present invention. For example, the plain carafe 10 without the indicator tab can be designated to contain regular coffee.

Figure 2:
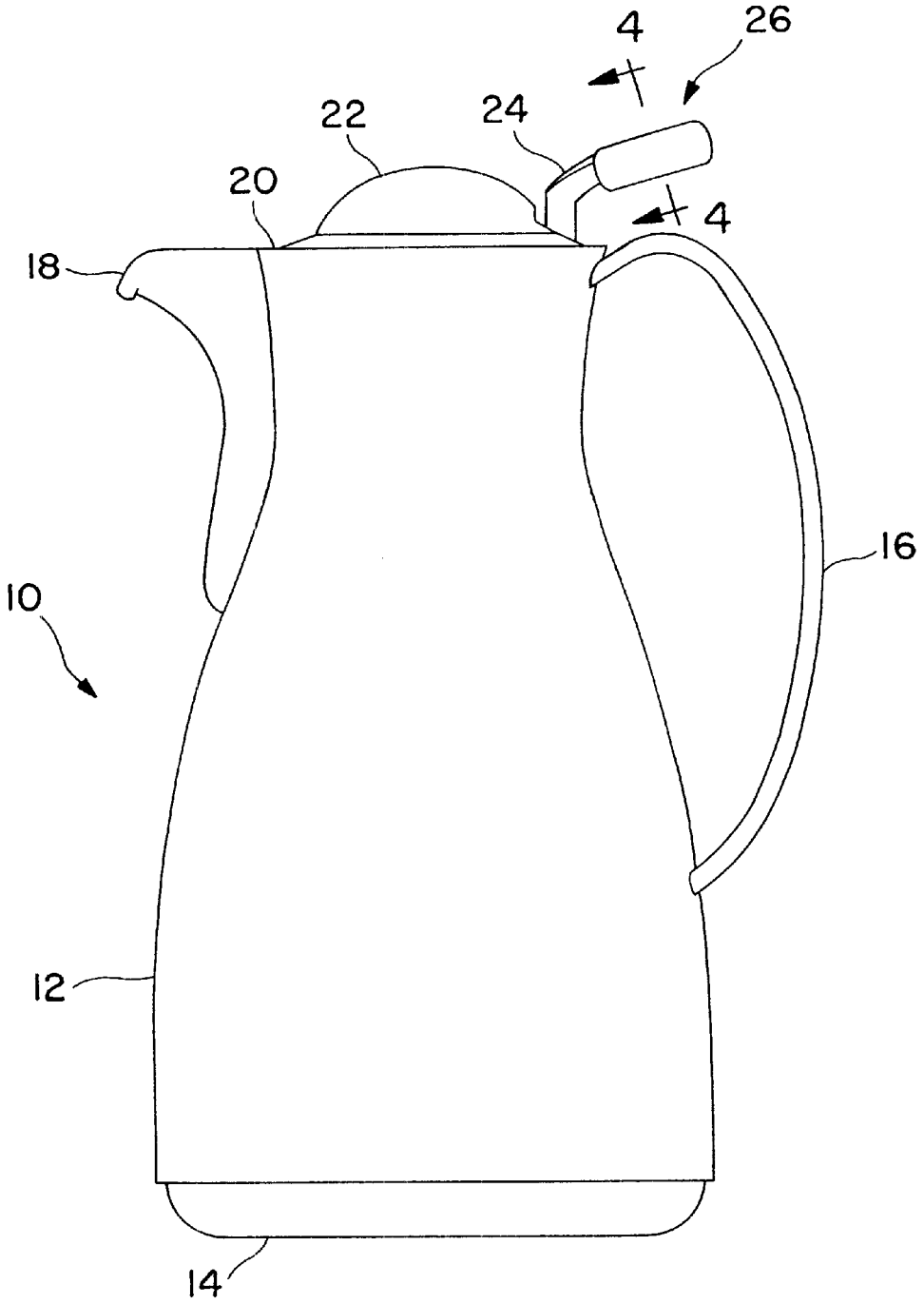
FIG. 2 is an elevational view of the carafe of FIG. 1, and further including an indicator tab in accordance with the present invention attached thereto.

Referring now to FIG. 2, the carafe 10 of FIG. 1 is again illustrated, but now includes an indicator tab 26 frictionally fitted over lid-lever 24. With indicator tab 26 in place on lid-lever 24 as shown in FIG. 2, carafe 10 can still be used in the aforementioned manner without interference. Lid-lever 24 can still be depressed by the user's thumb, now acting on lid-lever 24 via indicator tab 26, to open the seal of lid 22 and allow the contents to be poured from carafe 10.

In the configuration shown in FIG. 2, the contents of carafe 10 can be indicated by the presence of the indicator tab of the present invention. For example, the carafe 10 with the indicator tab attached thereto can be designated to contain decaffeinated coffee.

Referring to FIGS. 3–7, the indicator tab 26, configured in accordance with the present invention, is illustrated in greater detail. Indicator tab 26 comprises a generally hollow, box-shaped cap open on one side, or end, and closed on the remaining five sides. Top wall 28 and bottom wall 30 are curved convexly in a plane transverse to the longitudinal axis of indicator tab 26, and are substantially straight in a plane parallel to the longitudinal axis of indicator tab 26. Side walls 32 and 34 are substantially planar and parallel to each other and to the longitudinal axis of indicator tab 26. Closed end wall 36, disposed opposite open end 40, is substantially straight in a transverse direction from top wall 28 to bottom wall 30, but is convexly curved in another transverse direction from side wall 32 to side wall 34. Closed end wall 36 adjoins top and bottom walls 28 and 30, and side walls 32 and 34. Top and bottom walls 28 and 30 adjoin side walls 32 and 34. Open end 40 is defined by top and bottom walls 28 and 30, and side walls 32 and 34. The intersection of each of walls 28–36 with a next adjacent wall is radiused about the line of intersection.

Figure 3:
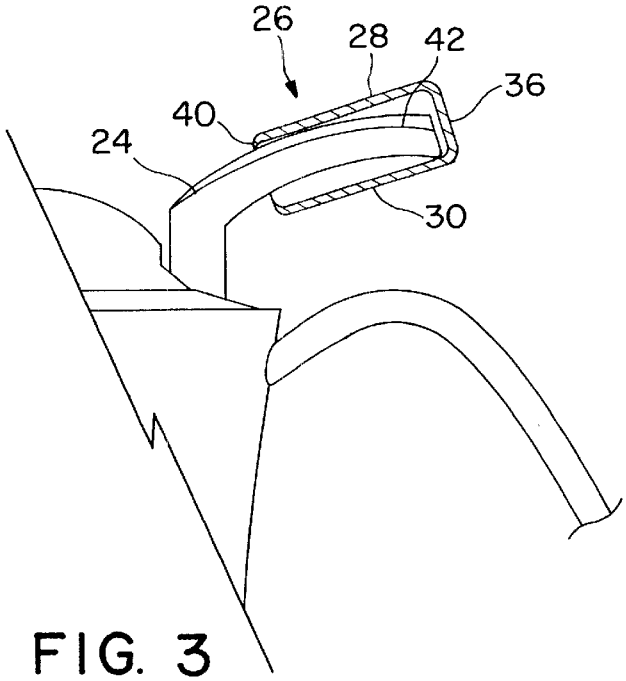
FIG. 3 is an enlarged elevational view of the carafe of FIG. 2, showing the indicator tab in longitudinal cross-section.
Figure 4:
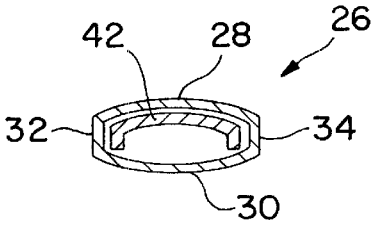
FIG 4 is a cross-sectional view of the lid-lever of the carafe and the indicator tab of FIG. 2, taken in plane 4—4 of FIG. 2 and viewed in the direction of the arrows.
Figure 7:
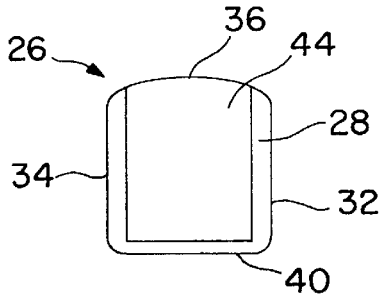
FIG. 7 is a top plan view of the indicator tab of the present invention.

With particular reference to FIGS. 3 and 4, lid-lever 24 has a top surface 42 that is curved convexly in two directions, i.e., in a longitudinal direction and in a transverse direction. The transverse curvature, as shown best in FIG. 4, is of substantially the same radius of curvature as that of top wall 28 and bottom wall 30 of indicator tab 26. Stated another way, the radius of curvature of top wall 28 and bottom wall 30 of indicator tab 26 is substantially the same as that of lid-lever 24 in the transverse direction. Consequently, indicator tab 24 can be placed onto lid-lever 24 with either top wall 28 or bottom wall 30 facing upwardly, i.e., lying next adjacent top surface 42 of lid-lever 24. The designations of "top" and "bottom" with respect to walls 28 and 30 are arbitrary, inasmuch as either wall 28 or 30 can be at the top, as desired.

Whereas lid-lever 24 is curved along the longitudinal direction, indicator tab 26 is substantially straight along the longitudinal direction. Consequently, as indicator tab 26 is pushed onto lid-lever 24, a point of interference is reached at which lid-lever 24 is wedged between top wall 28 and bottom wall 30 of indicator tab 26, resulting in a friction fit that retains indicator tab 26 on lid-lever 24. Indicator tab 26 can be removed from lid-lever 24 by applying sufficient pulling force to overcome the friction fit, but indicator tab 26 ordinarily will not come off of lid-lever 24 of its own accord during use. Therefore, a carafe 10 that has been marked by attaching indicator tab 26 thereto remains so marked until indicator tab 26 is intentionally removed.

Figure 5:
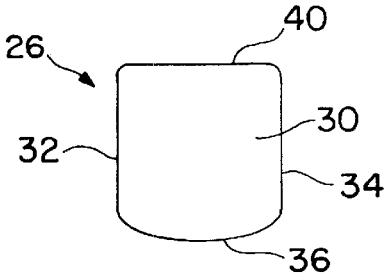
FIG 5 is a bottom plan view of the indicator tab of the present invention.
Figure 6:
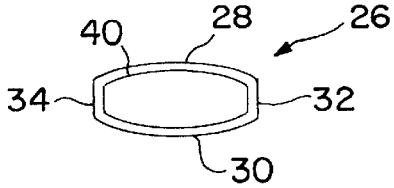
FIG. 6 is an end elevational view of the open end of the indicator tab of the present invention.

Referring particularly to FIGS. 5 and 6, indicator tab 26 is illustrated having a panel 44 of contrasting color inset into top wall 28, whereas bottom wall 30 has no such inset panel. Preferably, the body of indicator tab 26 is constructed of injection-molded plastic material of a first color, such as orange, whereas inset panel 44 is constructed of injection-molded plastic material of a second color, such as blue. Top wall 28 of indicator tab 26, having an inset panel 44 that is of a color distinct from the color of the remainder of indicator tab 26, including bottom wall 30, can serve as a further indicator of the contents of carafe 10. When indicator tab 26 is attached to lid-lever 24 with top wall 28 facing upwardly toward the user, the readily observable color panel 44, blue for example, can indicate to the user that the contents of the carafe are cold, or comprise regular coffee, for example. When indicator tab 26 is attached to lid-lever 24 with bottom wall 30 facing upwardly toward the user, the body color of indicator tab 26, orange for example, can indicate to the user that the contents of the carafe are hot, or comprise decaffeinated coffee, for example. Thus, by reversing the orientation of the color panel 44 of indicator tab 26 relative to lid-lever 24, different types of contents can be indicated. The correlation between the color of indicator tab 26 that faces upward and the contents of the carafe 10 is arbitrary and selectable by the user, as is the correlation between the presence or absence of indicator tab 26 and the contents of the carafe 10.

While the present invention has been described in detail with respect to a preferred embodiment illustrated in the drawings, the scope of the invention is not limited thereto. The invention in which applicant claims patent rights is defined by the claims appended below.

I claim:

1. An indicator tab for a carafe of the type having a lever with a free end extending therefrom, comprising:

a hollow cap having a top wall, a bottom wall, and a pair of side walls, the top and the bottom walls being spaced apart and connected to the side walls, the side walls being spaced apart and connected to the top and the bottom walls, the top wall, the bottom wall, and the pair of side walls defining with the top and the bottom walls one open end sized to receive the free end of the lever, the top wall being readily visually distinguishable from the bottom wall, and the cap being so receivable in at least two different orientations relative to the top wall.

2. The indicator tab of claim 1 dimensioned for frictional engagement with the lever of the carafe.

3. The indicator tab of claim 1, wherein the indicator tab has a longitudinal axis passing through the open end and at least the top and bottom walls are convexly curved in a plane transverse to the longitudinal axis.

4. The indicator tab of claim 3, wherein the top and bottom walls are substantially straight in a plane parallel to the longitudinal axis.

5. The indicator tab of claim 4, wherein the side walls are substantially planar.

6. The indicator tab of claim 1, and further including an end opposite the open end that is closed by an end wall.

7. The indicator tab of claim 1, wherein the top wall and bottom wall are of different colors, the colors being readily distinguishable from each other.

8. The indicator tab of claim 1, in which the indicator tab has a longitudinal axis passing through the open end, the top and bottom walls are substantially straight in a plane parallel to the longitudinal axis, and the lever is curved in a plane parallel to the longitudinal axis.

9. The indicator tab of claim 8, in which interference of the straight top and bottom walls with the curved lever provides frictionally engagement between the lever and tab.

10. A reversible indicator tab for a carafe of the type having a lever with a free end extending therefrom, comprising:

a hollow cap having a top wall, a bottom wall, and a pair of side walls, the top and bottom walls being spaced apart and connected to the side walls, the side walls being spaced apart and connected to the top and bottom walls, the top wall, bottom wall and pair of side walls defining at least one open end sized to receive the free end of the lever, the lever being receivable in at least two different orientations relative to the top wall, the top wall being readily visually distinguishable from the bottom wall.

11. The indicator tab of claim 10, dimensioned for frictional engagement with the lever of the carafe.

12. The indicator tab of claim 10, wherein the indicator tab has a longitudinal axis passing through the open end and at least the top and bottom walls are convexly curved in a plane transverse to the longitudinal axis.

13. The indicator tab of claim 12, wherein the top and bottom walls are substantially straight in a plane parallel to the longitudinal axis.

14. The indicator tab of claim 13, wherein the side walls are substantially planar.

15. The indicator tab of claim 10, and further including an end opposite the open end and closed by an end wall.

16. The indicator tab of claim 10, wherein the top wall and bottom wall are of different colors, the colors being readily distinguishable from each other.

17. The indicator tab of claim 10, in which the indicator tab has a longitudinal axis passing through the open end, the top and bottom walls are substantially straight in a plane parallel to the longitudinal axis, and the lever is curved in a plane parallel to the longitudinal axis.

18. The indicator tab of claim 17, in which interference of the straight top and bottom walls with the curved lever provides frictionally engagement between the lever and tab.

19. A method of indicating the contents of a carafe of the type having a lever with a free end extending therefrom, comprising the steps of:

a) providing an indicator tab removably attachable to the lever in at least two different orientations, each of the at least two orientations of the indicator tab being readily visually distinguishable from each other; and b) attaching the indicator tab to the lever in a selected one of the at least two orientations representative of the contents of the carafe.

* * * * *